US005423624A

United States Patent [19]

Richards

[11] Patent Number: 5,423,624

[45] Date of Patent: Jun. 13, 1995

[54] HINGED LOOSE-LEAF RETAINER SYSTEM

[76] Inventor: Donna E. Richards, 81 Via Concepcion, Riverside, Calif. 92506

[21] Appl. No.: 4,544

[22] Filed: Jan. 14, 1993

[51] Int. Cl.[6] ..... B42F 13/00

[52] U.S. Cl. ..... 402/13; 402/4; 402/19; 402/20; 402/21; 402/52; 402/75

[58] Field of Search ..... 402/4, 19–21, 402/8, 80 P, 13, 80 R, 63, 33, 64, 52, 68, 75

[56] References Cited

U.S. PATENT DOCUMENTS

| | | | |
|---|---|---|---|
| 187,367 | 2/1877 | Emerson . | |
| 546,484 | 9/1895 | Brown . | |
| 902,189 | 10/1908 | Wheildon . | |
| 908,596 | 1/1909 | Morden | 402/75 X |
| 1,082,335 | 12/1913 | Inghram . | |
| 1,538,249 | 5/1925 | Lorenz . | |
| 1,895,174 | 1/1933 | Shonts . | |
| 2,005,717 | 6/1935 | Coulston . | |
| 2,042,366 | 5/1936 | Swank | 402/75 X |
| 2,052,207 | 8/1936 | Berberich | 402/75 X |
| 2,099,881 | 11/1937 | Emmer . | |
| 2,206,317 | 7/1940 | Behn . | |
| 2,596,600 | 5/1952 | Rice | 402/75 X |
| 2,773,504 | 12/1956 | McGervey . | |
| 3,205,897 | 9/1965 | Jamison | 402/75 X |
| 3,270,749 | 9/1966 | O'Connell | 402/75 X |
| 3,467,479 | 9/1969 | Holes et al. . | |
| 3,485,564 | 12/1969 | Holes et al. . | |
| 3,501,814 | 3/1970 | Anderson et al. . | |
| 3,516,124 | 6/1970 | Merser . | |
| 3,638,967 | 2/1972 | Mullins | 402/75 X |
| 4,084,911 | 4/1978 | DeWitt . | |
| 4,269,530 | 5/1981 | Weber . | |
| 4,285,104 | 8/1981 | Corey et al. | 402/75 X |
| 4,886,390 | 12/1989 | Silence et al. . | |
| 4,925,328 | 5/1990 | Jefferies | 402/75 X |
| 4,932,804 | 6/1990 | Richards . | |
| 5,059,051 | 10/1991 | Corey | 402/75 |

FOREIGN PATENT DOCUMENTS

| | | | |
|---|---|---|---|
| 905409 | 4/1945 | France . | |
| 1455843 | 3/1965 | France | 402/75 |
| 1516328 | 1/1968 | France | 402/75 |
| 2523039 | 9/1983 | France | 402/75 |
| 239017 | 12/1945 | Switzerland . | |
| 323111 | 1/1930 | United Kingdom . | |
| 577762 | 6/1946 | United Kingdom . | |
| 795969 | 6/1958 | United Kingdom . | |
| 1010970 | 11/1965 | United Kingdom | 402/75 |

OTHER PUBLICATIONS

I.B.M. Technical Disclosure Bulletin, vol. 14, No. 4, Sep. 1971, "Random Access Binder", Binderwald & Boiney.

*Primary Examiner*—Frances Han

*Attorney, Agent, or Firm*—Knobbe, Martens, Olson & Bear

[57] ABSTRACT

A system for retaining stacks of loose-leaf papers in a file folder providing random access to any one sheet is disclosed. The system includes flexible retainer strips sized to fit through perforated holes in the paper and whose ends are configured to releasably couple to form enclosure rings. The ends are securely engaged by relative twisting and inserting of one into the other. A series of adjustment apertures along the length of the retainer allows the formation of varying sizes of enclosure rings. Loops secured to the file folder receive the retainer strips thus holding the paper stack to the folder. The loops are positioned proximate an edge of the folder and pivotally mounted with a rotational axis aligned with the edge so as to rotate from one side of the folder to the other. The front or back side of any sheet in the stack may thus be displayed flat for photocopying or other purpose without removal from the retainer system. The mounting support for the loops may be attached to an existing folder with conventional bendable metal tabs, or may include such bendable tabs and be adhesively or otherwise permanently secured to a folder by the manufacturer or by the user. The mounting support may be of various materials and include separate pivoting loops in a hinge or have loops integral with the support pivoting about one or more "living" hinges.

23 Claims, 10 Drawing Sheets

FIG. 15
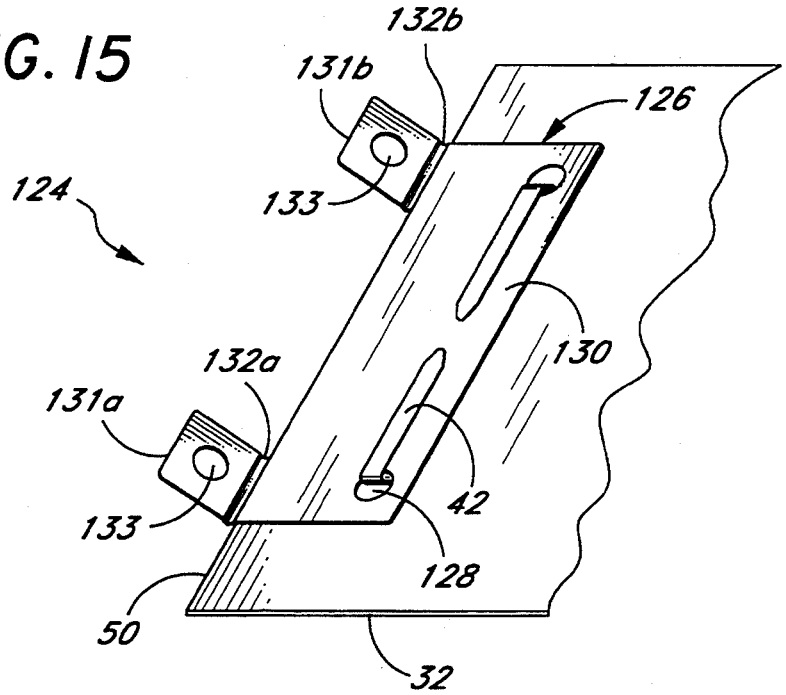
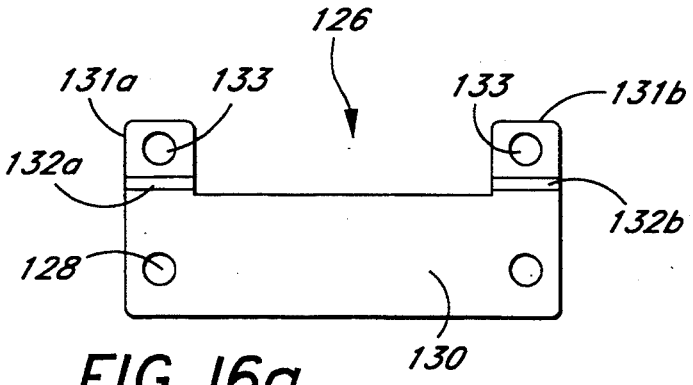
FIG. 16a
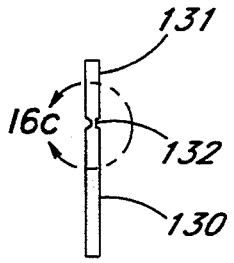
FIG. 16b
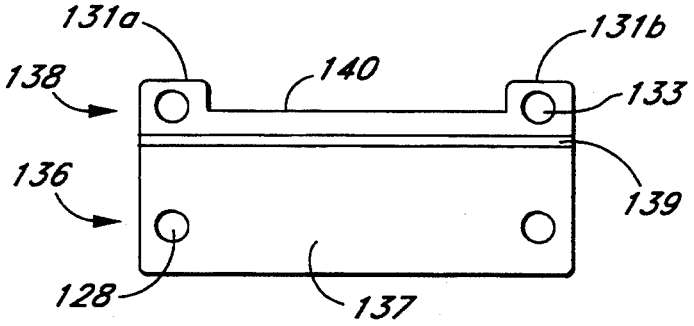
FIG. 17
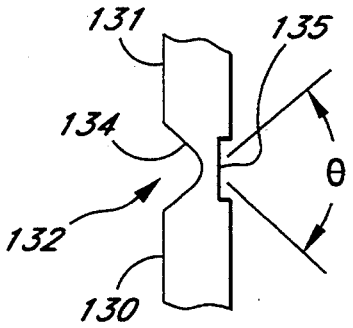
FIG. 16c

HINGED LOOSE-LEAF RETAINER SYSTEM

BACKGROUND OF THE INVENTION

1. Field of the Invention

This invention relates to loose-leaf file folders and has particular reference to a system for hingedly retaining loose leaves or sheets in such folders.

2. Description of the Prior Art

Conventional loose-leaf file retainers generally comprise a metallic U-shaped member having deformable tabs which are inserted through perforations in a file folder cover or flap and through perforations in a stack of loose sheets there to be bent over to retain the sheets in place. Alternatively, the portion of the U-shaped member between the deformable tabs may be fixed to the inside face of a file folder and the assembly sold as a ready-to-use item. Optionally, a locking cross member may be added on top of the stack of loose sheets to retain the deformable tabs in place. In order to insert or remove a selected sheet from an interior position in the stack, all the sheets in the stack above that position must be removed from the tabs and replaced afterward.

Although such conventional sheet retainers are generally satisfactory, the process of removing a portion of a stack, particularly if it is quite thick, and then replacing it by guiding the relatively flexible retainer tabs through sometimes misaligned perforations is somewhat tedious and can result in some of the sheets being misplaced or replaced out of order. Additionally, in order to simply photo copy a sheet within the middle of a large stack requires either a removal and replacement process as described. Also, such retainers generally clamp the sheets together along one edge so that those sheets above a selected one in a stack cannot be laid back flat, but must be bent or curled back upon themselves. This again presents an inconvenience when attempting to copy and makes it awkward to read a sheet within the stack, especially when handling a file containing a relatively thick stack of sheets.

In U.S. Pat. No. 4,932,804 to Richards, a loose-leaf retainer for file folders is shown. Flexible, plastic retainer strips extend through guide channels in anchor elements secured to the cover of a file folder. The flexible retainer strips have connecting ends to form a closed loop and contain a stack of loose sheets through perforated holes in the sheets. The connection at the ends of the retainer strips comprise a generally bulbous head on one end providing a friction fit into a mating socket on the other end. Sockets are also formed between the ends to adjust the loops to fit the stack of sheets. The full loops can rotate in the paper holes to permit removal or insertion of a sheet in any location in the stack without removing other sheets. Also, the loops permit a portion of the stack to be rotated 180° and lie flat. However, the sheets cannot be rotated 360° from one side of the file folder to the other to enable a sheet to lie flat on a photocopy machine because the anchor elements fixed on the first side of the file folder interfere.

The present invention provides several improvements over prior loose-leaf retainer systems.

SUMMARY OF THE INVENTION

In one aspect of the present invention, an improved retainer for loose-leaf sheets of paper is provided. The retainer comprises a thin strip of durable, yet flexible, material sized to pass through perforations in loose-leaf sheets of paper and be joined into a closed loop. The ends of the retainer are configured to be firmly joined or locked together after a relative twisting action allows a projection in one end to fit within a cavity or socket in the other end. After the projection is fitted in the socket, the ends relax and return to their original orientation such that the projection may not retract from the socket. The preferred angle of twist is at least 45° and no more than 90°.

Preferably, the retainer strips have a primarily thin rectangular cross section with gradually tapering frusto-conical ends terminating in end faces. A first end of the retainer comprises a male end with the projection extending axially therefrom. The projection has generally an arrowhead shape with a narrow neck and a widened head. The entrance to the socket on the other end is sized to receive the head of the projection when the ends are oriented with respect to one another a certain way. The base of the socket opens up into a widened cavity which may receive the head of the projection in any orientation. In a relaxed state of the retainer, the projection will not fit through the aperture.

The preferred retainer also includes a series of axially aligned adjustment slots along the midsection to enable the creation of closed loops capable of retaining snugly various sizes of paper stacks. The projection of the male end of the retainer is sized to fit within a portion of an adjustment slot whereupon the projection may be locked within the slot by moving the projection along the slot. Preferably, the slot includes a head receiving portion and a neck receiving portion separated by two projecting nubs. The projection thus fits through the head receiving portion until the head of the projection extends out the back side of the retainer. The neck of the projection is then forced past the projecting nubs into the neck receiving portion and the head is sized to prevent retraction from the neck receiving portion.

In accordance with a further preferred aspect of the present invention, the retainers are configured to fit through hinge loops attached to the top of a file folder. The hinge loops are positioned to rotate about the top edge of the folder so that they can lie substantially flat against either the top or bottom faces of the folder. Loose-leaf papers held by the closed loop retainers may also rotate around from the top face of the folder to the bottom face, facilitating photocopying of any particular sheet. Thus, the retainers with the hinge loops provide a system that has adjustable, random access to any sheet and permits flat copying of any sheet without removal from the file folder.

The hinge loops are pivotably attached to a hinge support which is demountably or permanently affixed to the file cover. In one embodiment, the hinge support includes holes which receive existing bendable metal strips of the file folders to provide a "conversion kit" for file folders and metal strip retainers already in office supply. In another embodiment, the hinge support includes the bendable metal strips and is glued to the file cover to provide a "blended" looped hinge retainer system. In a further embodiment, the hinge support comprises a simple plate which may be affixed to the top edge of a file cover to work in conjunction with existing bendable metal retainer tabs. Both the "blended" and simple plate hinge supports may be affixed to file covers prior to retail sale as an assembled unit or, alternatively, sold as separate items to be selectively affixed to file covers at the buyer's discretion.

The hinge support and hinge loops are preferably constructed of a single piece of polyurethane with a "living hinge" formed between the hinge loops and hinge support. The living hinge is provided by narrowing the thickness of the material at the hinge location to provide a line about which the hinge loop may pivot. In the preferred form, the living hinge includes a deep groove on the underside of the hinge support and a shallow channel on the top side. The hinge loops may then pivot a predetermined angle around the back side of the file folder until the sides of the groove contact each other, but may pivot to lie completely flat against the top side of the hinge support by virtue of the shallow channel. The hinge loops may pivot independently of one another or, alternatively, may be coupled by a bridge portion eliminating skewing of documents held by the hinged retainer system. The plastic hinge support of the preferred embodiment is provided with apertures to receive existing metal tabs for retaining the hinge support on an existing file folder.

In a further configuration, the plastic hinge support includes a thickened region at the top edge of the file folder, including a channel for receiving a metal hinge rod. The thickened region comprises a C-shaped channel whose top edges span a distance slightly smaller than the thickness of the metal hinge rod. The hinge rod is forced between the edges of the open channel, to be retained yet rotate within the channel. The hinge rod includes two loops bent into the ends to provide the hinge loops for receiving the retainers of the present invention.

Several other configurations of the "conversion kit" are contemplated. In one such configuration, the hinge support comprises a thin metal or plastic plate which includes an elongated looped section for receiving the midsection of the hinge rod. The looped section runs parallel to the top edge of the file folder so that the loops of the hinge rod may rotate around the top edge. In another case, the hinge support comprises a metal or plastic piece having a main body portion and two extending fingers, which fingers are looped back at the ends to form two swivel apertures for receiving the aforementioned hinge rod. The supports may be glued or riveted to the file folders. And in another form, the hinge support comprises relatively stiff paper which has been looped around and folded under at an end parallel to the top edge of the file folder to form a closed channel for receiving the hinge rod.

The materials and hinge loops of the "blended" configuration may be of various types. Preferably, the hinge loops are formed by the bent end portions of a hinge rod which is retained within a channel formed by folding an end of a paper hinge support. The bendable metal tabs are attached to the hinge support by glue or other means, and the whole assembly then bonded to the file folder or provided with a peel-off strip for selective attachment to file folders.

Alternatively, the "blended" hinge support is formed of metal having an elongated main body portion terminating in the bendable tabs and having two fingers extending towards the top edge of the file folder which loop around to form two spaced swivel guides for the hinge rod. A paper covering strip may be used to hold the hinge support to the file folder, or the hinge support may be riveted or directly epoxied or glued to the file folder. In still another form, the hinge support may be a metal piece having the bendable metal tabs and a central portion whose end is bent upward and back into an elongated channel for pivotably retaining the hinge rod. As with the prior embodiment, a paper covering strip may be used to hold the metal hinge supports of the file folder or, alternatively, rivets or epoxy may be used.

The hinged retainer systems which are designed to be applied to a file folder and used in conjunction with the existing bendable metal retainer tabs are preferably formed from sheets of stiff paper. In one embodiment, an end parallel to the top of the file folder is folded under and glued to form an elongated channel for receiving a metal hinge rod having end loops. In another embodiment, the hinge loops are defined by two holes in tabs extending from the body of the hinge support, the tabs being pivotable about the hinge support at the integral junction, as with a "living hinge." In another embodiment, the tabs are coupled by a bridge portion so as to pivot together. In a further embodiment, a single paper hinge support is bent along the line proximate the top edge of the file folder to form a pivotable flap. Rivets or other strengthening members are attached to the pivotable flap to form the apertures or hinge loops for the retainers of the present invention.

In accordance with the method of the invention, sheets are held in a stack by the retainer described above. In a further aspect of the method, sheets are held by retainers that provide random access, and the retainers are positioned in loops hinged at the top edge of a file folder to permit any sheet to lie completely flat to be copied by a copy machine without removal from the file.

BRIEF DESCRIPTION OF THE DRAWINGS

FIG. 15 is a perspective view of a preferred embodiment of a hinge and support for the retainers of the present invention arranged to be secured to a file folder with bendable tabs;

FIG. 16*a* is a top elevational view of the hinge support of FIG. 15;

FIG. 16*b* is a side elevational view of the hinge support of FIG. 15;

FIG. 16*c* is a detailed view of the living hinge of the hinge support of FIG. 15;

FIG. 17 is a top elevational view of an alternative configuration of the hinge support of FIG. 15.

DESCRIPTION OF THE PREFERRED EMBODIMENTS

Figure 1:
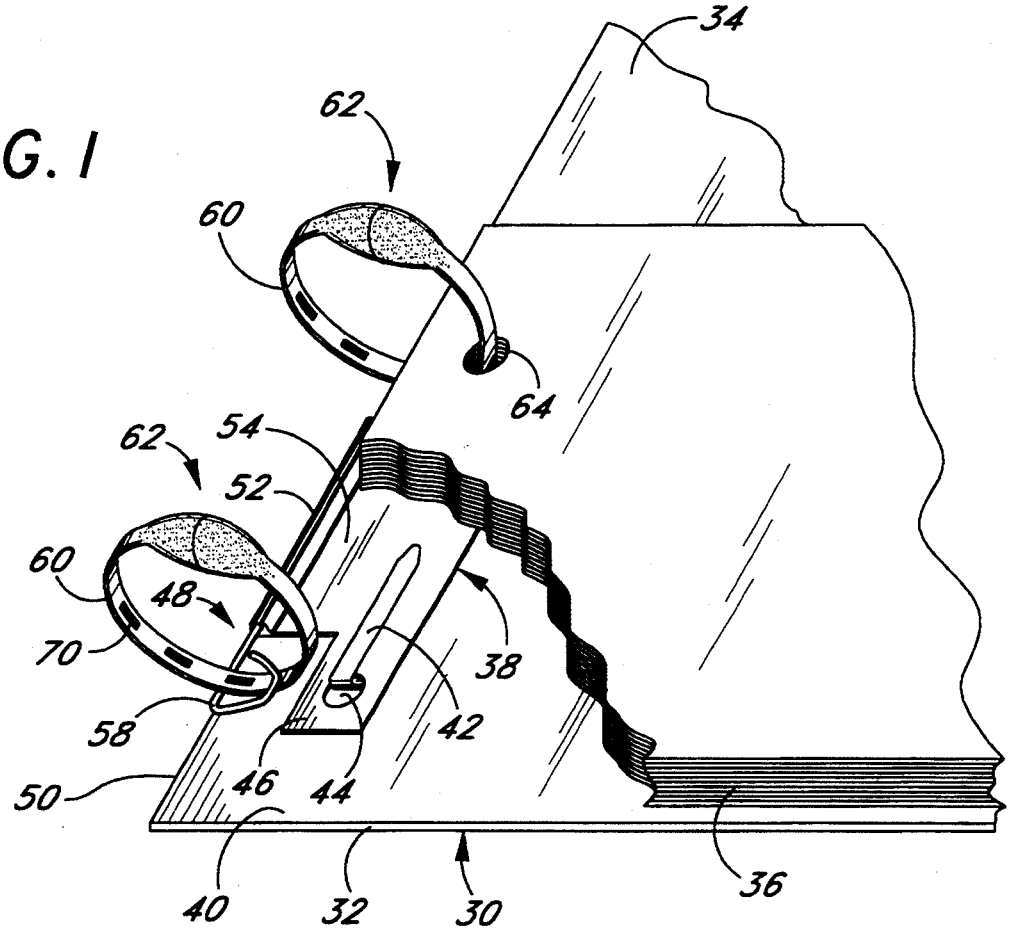
FIG. 1 is a perspective view, with parts cut away, of a file folder in combination with a preferred form of the hinged retainer system of the present invention.

Referring first to FIG. 1, there is shown a conventional file folder, indicated generally at 30, comprising file panels or covers 32 and 34 of relatively stiff paper or the like, which are suitably hinged together in a manner not shown for movement from an open condition, shown in FIG. 1, to a closed condition, wherein one cover is folded over the other to contain a stack of loose-leaf sheets 36 therebetween.

HINGED RETAINER SYSTEM

A hinge member or support 38 lies flush against a first face 40 of the file cover 32 proximate an upper edge 50. The hinge support 38 is detachably held to the first face 40 with a pair of bendable metal prongs or tabs 42 mounted to, or protruding through, the cover 32. The tabs 42 extend through a pair of apertures 44 in a pair of lateral wing flaps 46 of the hinge support 38. As is well-known in the art, the metal tabs 42 extend through the apertures 44 and fold laterally inward or outward to constrain the hinge support 38 relatively flush with the file cover 32.

A hinge mechanism 48, disposed parallel and adjacent to the upper edge 50 of the cover 32, comprises an elongated hinge tube 52 of a middle portion 54 of the hinge support 38 rotationally supporting a straight center portion 56 (FIG. 11) of a hinge rod intermediate a pair of end loops or hoops 58. Each end hoop 58 is sized to receive a flexible retainer 60 which extends through the hoops and has ends which engage at a junction 62 to form a closed loop. The retainer 60 also extends through perforations 64 in the loose-leaf sheets 36. Thus, the loose-leaf sheets 36 are attached to the file cover 32 via the metal tabs 42 holding the hinge support 38, the hinge support 38 retaining the hinge rod, and the hoops 58 receiving the retainers 60 which also pass through the perforations 64 in the loose-leaf sheets.

Figure 2:
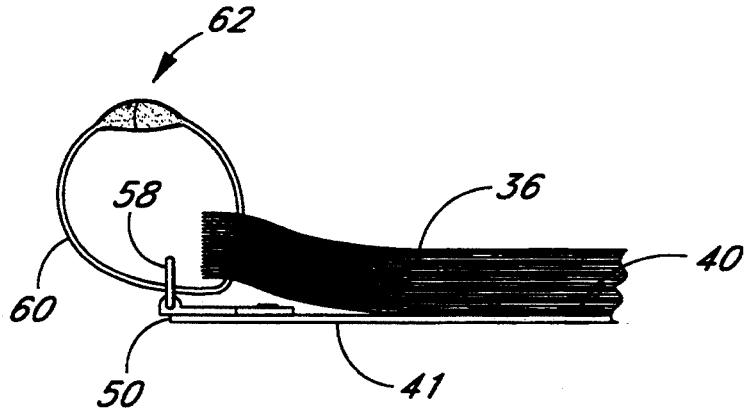
FIG. 2 is a partial side elevational view of the file folder and hinged retainer system shown in FIG. 1.
Figure 3:
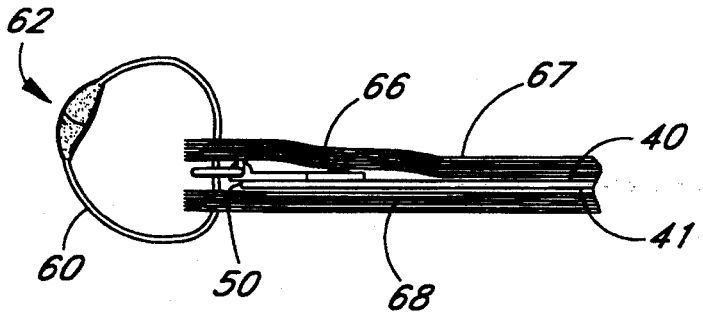
FIG. 3 is a partial side elevational view showing the file folder and hinged retainer system with a number of loose sheets rotated to lie flat against an opposite side of the file folder.
Figure 4:
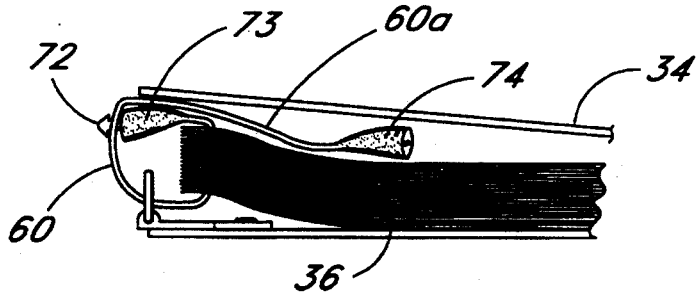
FIG. 4 is a partial side elevational view of the file folder and hinged retainer system with a preferred retainer adjusted to provide a closed-loop portion closely encircling the stack of loose-leaf sheets with the remaining portion lying flat underneath an upper cover.

Now looking at FIGS. 2–4, the particular advantages of the file folder and hinged retainer system of the present invention will become apparent. FIG. 2 shows a side view of the file folder whereby each retainer 60 joined together at the junction 62 comprises a closed loop passing through the end hoops 58 and perforations 64 of the loose-leaf sheets 36.

In order to copy one page in the middle of the stack of loose sheets 36, a group of sheets 68 above the desired document 67 will be lifted and rotated around the closed loop to lie flat against a second face 41 of the file cover 32, as shown in FIG. 3. As illustrated, the hoops 58 have rotated counter-clockwise and outward from the upper edge 50 of the cover so that the retainer 60 passes directly vertically through a remaining group of sheets 66 and the rotated group of sheets 68. Thus, the loose sheets lie flat at all times, as opposed to prior designs which required the sheets to be folded or curled back for copying purposes.

Additionally, in the configuration of FIG. 3, the upper sheet 67 of the upper group 66 may be removed from the stack by disengaging the retainer at the junction 62. The upper sheet 67 may be later reinserted into the same place in the stack 36 without removing any of the other sheets. This enables the user of the system to access a random sheet within the stack 36 without risk of shifting the order.

Referring to FIGS. 1 and 4, the retainer 60 includes an adjustment means wherein the closed loop may be reduced in size depending on the number of sheets of paper in the stack 36. As shown in FIG. 1, and as will be described in more detail later, the adjustment means comprises adjustment slots 70 evenly spaced along the length of the retainer 60. A projection 72 on a male end 73 of the retainer 60 extends through and locks in one of the slots 70. As shown in FIG. 4, this forms a small closed loop slightly larger than necessary for surrounding the stack of the loose sheets 36. A female end 74 of the retainer 60 extends along the upper face of the stack 36 between the stack and the upper file cover 34. Advantageously, any number of sheets may be held within the closed loop of the retainer 60, limited only by the length of the retainer.

The particular configuration shown, wherein the projection 72 is on one end 73 and the other end 74 has the female portion, is only illustrative of the preferred embodiment. However, it is preferred that the projection 72 be on the end which extends up through the perforations 64 in the stack so that the excess retainer 60*a* lies flat against the stack when the projection locks in an adjustment slot 70 to form a small closed loop.

PREFERRED RETAINER

Referring to FIGS. 5–9, the preferred retainer 60 comprises an elongated thin strip of flexible material, preferably an elastomer such as Riteflex 672, having ends 73 and 74 separated by an intermediate portion 76 including the evenly spaced adjustment slots 70. The intermediate portion 76 is preferably rectangular in cross section with a thickness of approximately 0.044 inches and a width of approximately 0.15 inches. The ends 73, 74 comprise gradually widening generally conical tapers 75, 77, respectively, terminating in circular flat end faces 73*a*, 74*a*. The taper 77 on the female end 74 is typically sized longer than the other taper 75 for axial stiffness and ease of threading through thick stacks of paper, as will be described below. The projection 72 extends from the flat end face 73*a* and is configured to lock in a receiving socket 78 in the flat end face 74*a* of the female end 74 or, alternatively, lock in any one of the adjustment slots 70.

In the preferred embodiment, the retainer 60 has a length of approximately 6 inches and a first adjustment slot 70*a* at a distance of approximately 1.6 inches from the male end 73. The adjustment slots 70 are preferably spaced approximately 0.3 inch apart and extend the length of the retainer 60 to a final adjustment slot 70*b* proximate the female end 74. Thus, by curling the male end 73 towards the first adjustment slot 70*a* and locking it therein, a closed loop of approximately ½ inch diameter may be formed. In a similar manner, the male end 73 may be looped around to engage the receiving socket 78 in the female end 74 to form a closed loop approximately 2 inches in diameter. The intermediate range of closed loops thus increases in size from the connection of the male end 73 to the first adjustment slot 70*a* by increments of 0.3 inch in the circumference until the largest closed loop is formed with the ends 73 and 74 joined at the junction 62. Moreover, two or more retainers 60 may be coupled end-to-end to increase the maximum sized loop possible.

Figure 5:
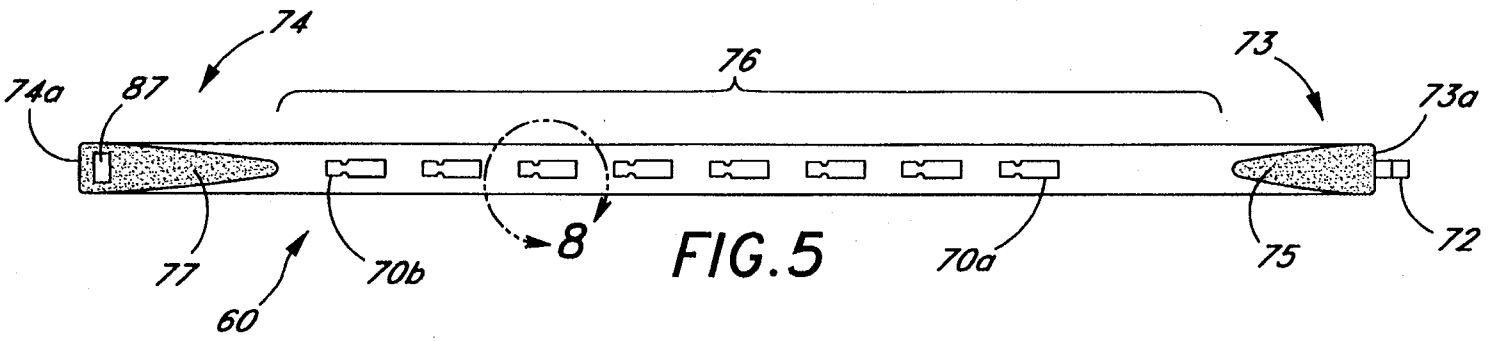
FIG. 5 is a top plan view of a preferred retainer of the present invention.
Figure 9:
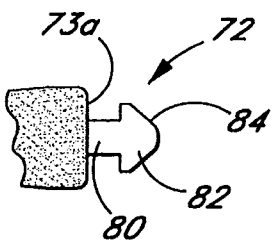
FIG. 9 is an detailed view of a locking projection of the retainer.

Now referring in more detail to the junction 62, the projection 72, as best seen in FIG. 9, has a neck 80 terminating in a forward head 82. Preferably, the neck 80 has a generally square cross section of approximately 0.044 inch per side and extends 0.05 inches from the end face 73*a*. The head 82 has a leading end 84 which is pointed or arcuate in configuration and the tip of the leading end extends approximately 0.05 inch farther than the neck. The head 82 is as narrow as the neck 80 in one dimension, as seen in FIG. 5, but the lateral sides extend outward further for a span of approximately 0.1 inch. The resulting projection 72 resembles a blunt arrowhead.

Figure 6:
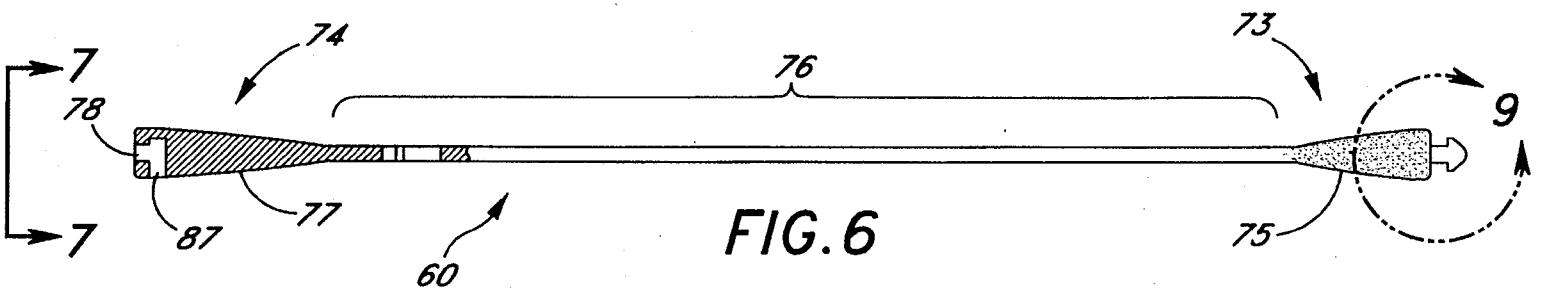
FIG. 6 is a side elevational view, partially cut-away, of the retainer of FIG. 5.
Figure 7:
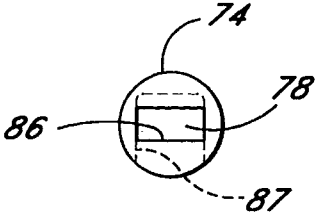
FIG. 7 is an end elevational view of the retainer taken along line 7—7 of FIG. 5.

As seen in FIGS. 6 and 7, the receiving socket 78 includes a rectangular entry 86, sized approximately 0.11 inch to receive the full width of the head portion 82 and slightly larger than the neck 80 in the short direction to permit the neck to rotate. A transverse rectangular channel 87 from an exterior side of the female end 74 extends slightly past the rectangular entry 86. The transverse channel 87 has a width equal to the width of the entry 86 and provides a clearance space within which the head may freely rotate. The channel opens to the side only for ease of molding.

JOINDER OF RETAINER ENDS

Figure 10A:
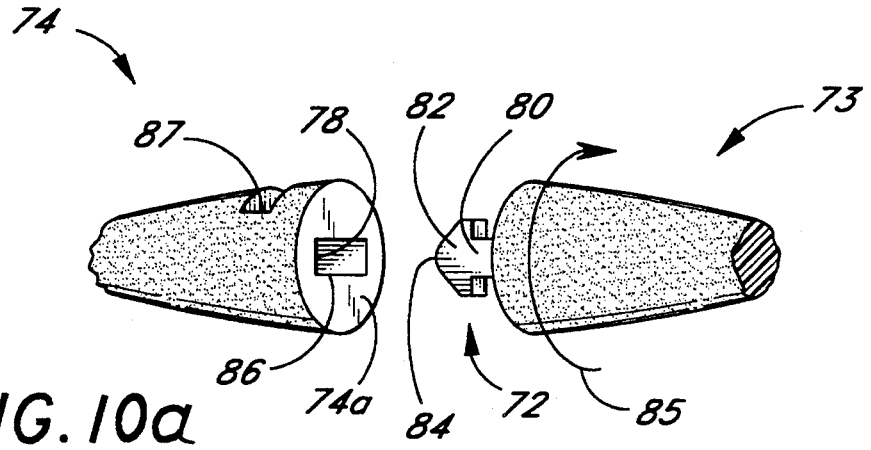
FIG. 10*a* is a perspective view of opposing ends of the retainer of FIGS. 5 and 6 in a relaxed disengaged position.
Figure 10B:
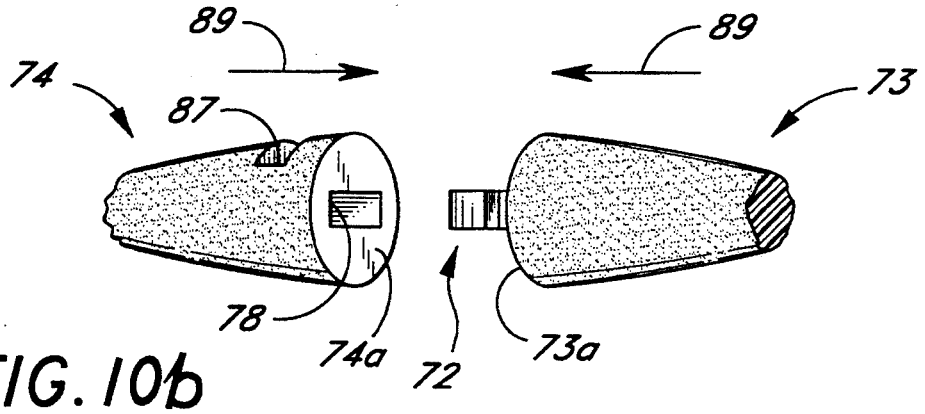
FIG. 10*b* is a perspective view of the disengaged retainer ends with one end twisted relative to the other prior to engagement.
Figure 10C:
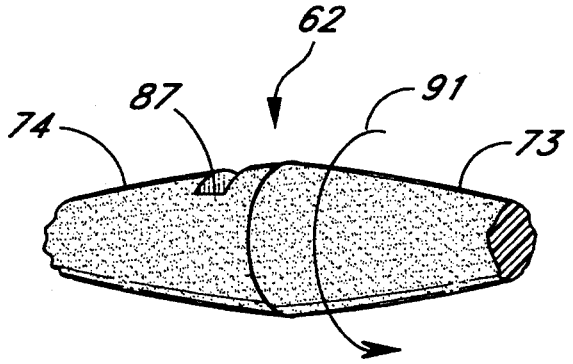
FIG. 10*c* is a perspective view of the retainer ends after having been engaged.

Referring to FIGS. 10*a*–10*c*, the attachment of the male end 73 to the female end 74 is only accomplished by twisting one or both of the ends thickened relative to one another at least 45° to insert the projection 72 into the socket 78 and then releasing the ends to allow them to relax into their original orientation, thus locking the ends together. The central section 76 of the retainer 60 provides a thin cross section, and thus minimal torsional stiffness, to facilitate the twisting action. The tapers 75, 77 are provided with a roughened surface to further enhance gripping.

As shown in FIGS. 10*a* and 10*b*, prior to engagement the male end 73 is rotated approximately 90° in either direction, as shown by arrow 85, to orient the head portion 82 into alignment with the rectangular aperture 86. The two ends 73 and 74 are brought together as shown by arrows 89 so that the projection 72 fits within the socket 78 until the end faces 73*a*, 74*a* abut one another. At this point, as shown in FIG. 10*c*, the male portion 73 is allowed to relax and untwist, as shown by arrow 91, causing the lateral sides of the head portion 82 to rotate into the rectangular channel 87, thus locking the projection 72 within the socket 78 by virtue of the head now being too large to fit out of the narrow dimension of the aperture 86. The neck portion 80 is sized to rotate freely within the aperture 86.

To unlock the ends 73 and 74, a reverse procedure is followed. Either end is twisted approximately 90° to key the head 82 with the aperture 86, and the ends pulled apart. The head 82, sized slightly smaller than the aperture 86 and having the arrowhead shape, enables the end 73 to be more easily detached from the second end 74 by first twisting and then tilting slightly, rather than simply pulling apart axially. This allows the junction 62 to be disassembled when the head 82 is not exactly aligned with the aperture 86, rendering the separation step easier and more reliable. Additionally, the ease of separation at various angles of twist helps prevent damage caused by excessive axial loading.

Other configurations of the mating components of the junction 62 are contemplated. In one example, the projection 72 may have outwardly radially extending fingers, in a star shape, the projection being pre-twisted to insert within a similarly star-shaped aperture in the female end 74 and thereby released to prevent the projection from backing out of the socket 78. In general, the head portion 82 may be shaped in any manner so that it has a narrow dimension and a wide dimension sized to fit through a similarly shaped aperture 86 when oriented one way, yet prevented from passing through the aperture when oriented in any other way. Additionally, the aperture 86 may be cylindrical having a single keyway on one side into which a key projection on a male portion may extend when the male end 73 is twisted. The male portion thus cannot retract out of the aperture when the male portion is inserted and allowed to relax.

ADJUSTABLE RETAINER

Referring again to FIGS. 5 and 8, the adjustment slots 70 comprise axially aligned, generally rectangular apertures having a head receiving portion 90, a neck receiving portion 92, and inwardly extending opposing nubs 94 separating the head and neck receiving portions forming a narrow region in the slots. The head 82 of the projection 72 fits through the head receiving portion 90 until the end face 73*a* contacts the retainer 60 with the neck portion 80 in the slot and the head portion protruding from the opposite side. The neck portion 80 is then forced axially along the retainer 60 past the nubs 94 to reside in a locked position in the neck receiving portion 92. One of the laterally extending flanges on the head portion 82 provides a stop against the rear side of the retainer 60, locking the projection into the adjustment slot 70. The nubs 94 are spaced apart a distance slightly smaller than the thickness of the neck portion 80 such that once pushed past the nubs, the projection 72 is held relatively securely within the neck receiving portion 92. Preferably, the slot 70 has a narrow width of approximately 0.05 inch, a length of 0.17 inches and the nubs 94 reduce the width to approximately 0.038 inches.

In an alternative configuration, the head portion 82 has a thickness greater than the neck portion 80. The head receiving portion 90 also has a width slightly greater than the neck receiving portion 92. The projection 72 is thus more securely held in the locked position in the slot 70 by at least two overhanging edges of the head portion 82 contacting the edge of the neck receiving portion 92.

Figure 8:
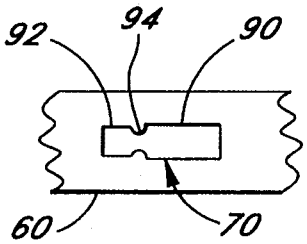
FIG. 8 is an detailed view of an adjustment slot of the retainer.

Referring to FIG. 4 and the detail of FIG. 8, the projection 72 extends through an adjustment slot 70 and has been locked into place into the neck receiving portion 92 which is on the upper side of the slot. As will be apparent from the drawing, the projection 72 was inserted through the lower head receiving portion 90 at which point the closed loop was pulled to generally widen the loop causing the neck 80 to cam over the nubs 94 into the locked position in the neck receiving portion 92. The natural resiliency of the retainer material 60 also assists in keeping the projection 72 at the upper end of the slot 70 held in the neck receiving portion 92 by virtue of the tendency for the loop to expand.

CONVERTIBLE HINGED RETAINER SYSTEMS

Figure 11:
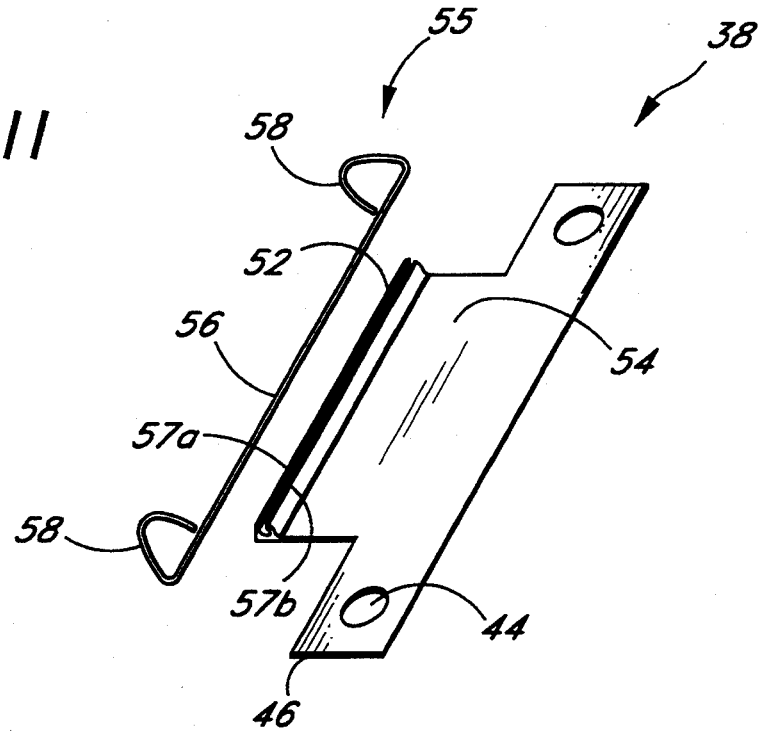
FIG. 11 is a perspective view of one embodiment of a hinge and support for the retainers of the present invention arranged to be secured to a file folder with bendable tabs.

Referring to FIG. 11, the hinge support 38 comprises a tough polymer material such as polypropylene and defines a flat widened T-shape with the middle portion 54 extending out in the lateral wing flaps 46. The elongated open hinge tube 52 receives the hinge rod 55 in a close rotational fit, the rod being retained in the tube by two opposing edges 57*a*, 57*b* defining an elongated slot and being spaced slightly less than the rod diameter. In this respect, the central portion 56 of the rod may be forced past the opposing edges 57 to be retained and allowed to rotate in the tube 52. The close fit of the tube 52 around the hinge rod reduces wear associated with any relative movement other than relative rotational movement. The open tube 52 of the hinge support 38 is preferably molded into the appropriate shape. The width of the open tube 52 of the hinge support 38 spans the distance between the hoops 58 and is slightly smaller to allow the center rod 56 to rotate nearly 360°, within yet constrain the end hoops from moving laterally more than approximately 2 mm. Thus, the hinge rod is held in alignment with the hinge tube 52, and with the upper edge 50 of the file cover 32 when the hinge support 38 is installed.

The apertures 44 are formed in the wing flaps 46 a distance of approximately 2.75 inches apart, that being the typical distance between conventional perforations 64 in paper. The hinge rod 55 is preferably formed from common music wire or the like, and comprises the center straightened portion 56 and the two end hoops 58. The hinge rod is formed from a straightened piece of wire of approximately 4.5 inches long and a diameter of 0.045 inch, which is bent at the ends to form the hoops 58. The hoops 58 have a sufficient size to receive the retainer 60 and are centered approximately 2.75 inches apart, the typical span between perforations in paper.

As seen in FIGS. 2–4, the hinge support 38 is sized to be held on the file folder with the bendable tabs 42 such that the open tube 52 and hinge rod 55 extend slightly past the upper edge 50 of the cover 32. In this manner, the hinge rod may rotate substantially all the way around to the back side 41 of the cover so that the retainer and the whole stack 36 of loose-leaf sheets may also be pivoted about the open shaft 52 and rotated to the underside of the cover. Moreover, contact between the rotating hoops 58 and top edge 50 of the file cover is substantially eliminated due to the extending position of the shaft 52, reducing wear on the cover.

The hinge support and hinge mechanism, as shown in FIG. 11, is designed to be an add-on feature of an existing file folder 30. In this respect, the existing file folder with bendable metal tabs 42 are used for small stacks of loose-leaf sheets until the stack becomes cumbersome and unwieldy. The loose-leaf sheets are then removed, and the hinge support 38 attached to the file folder with the bendable tabs 42 extending through the apertures 44 and bent over laterally to lie flush with the file cover 32. Alternatively, the hinge support 38 may be installed prior to use of the folder without interfering with the metal tabs.

The female end 74 of a flexible retainer 60 threads down through the perforations 64 in the loose-leaf sheets from the top side, the long taper 77 facilitating the threading of the retainer 60 through the sometimes misaligned perforations 64 in a large stack of paper. Thus, a larger portion of the stiff taper 77 is available to grip and guide through the perforations as the end 74 disappears into the stack. The end 74 is inserted through each hoop 58 and bent up around the end of the paper stack 36 with the male end 73 sticking upright from the perforations 64. When the retainer 60 is joined in a small loop with the projection 72 locked into one of the adjustment slots 70, as in FIG. 4, the female end 74 will lie on top of the stack of loose-leaf sheets 36.

If a sheet from the middle of the stack 36 is to be removed or has to be photocopied, the projection 72 is moved longitudinally in the adjustment slot so that the head 82 may retract from the head receiving portion 90 of the slot. The end 73 is then brought into proximity with the end 74 and twisted at least 45° to couple the two ends in the manner described with reference to FIGS. 10*a–c*. A similar operation is carried out for both retainers 60. The stack of loose-leaf sheets may then be completely rotated around the file cover 32, or only a portion of the sheets rotated, to expose a desired sheet for removal or copying. At this point, the two ends 73, 74 are disengaged and the desired sheet removed or, alternatively, the sheet may be placed flat on a copy machine without removing the sheet by virtue of the improved hinged retainer system of the present invention.

Figure 12:
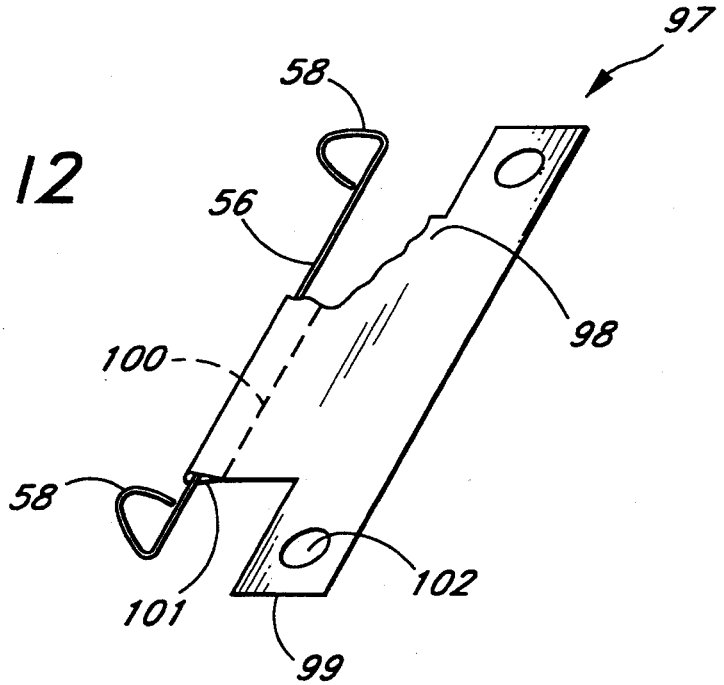
FIG. 12 is a perspective view of an alternative embodiment of a hinge and support for the retainers of the present invention arranged to be secured to a file folder with bendable tabs.
Figure 13:
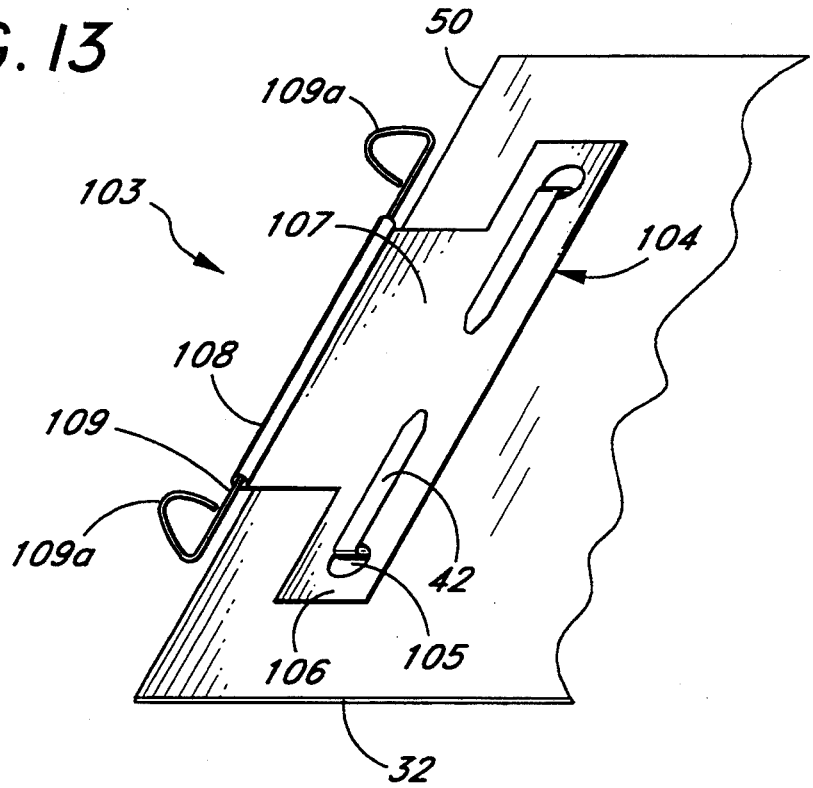
FIG. 13 is a perspective view of an alternative embodiment of a hinge and support for the retainers of the present invention arranged to be secured to a file folder with bendable tabs.
Figure 14:
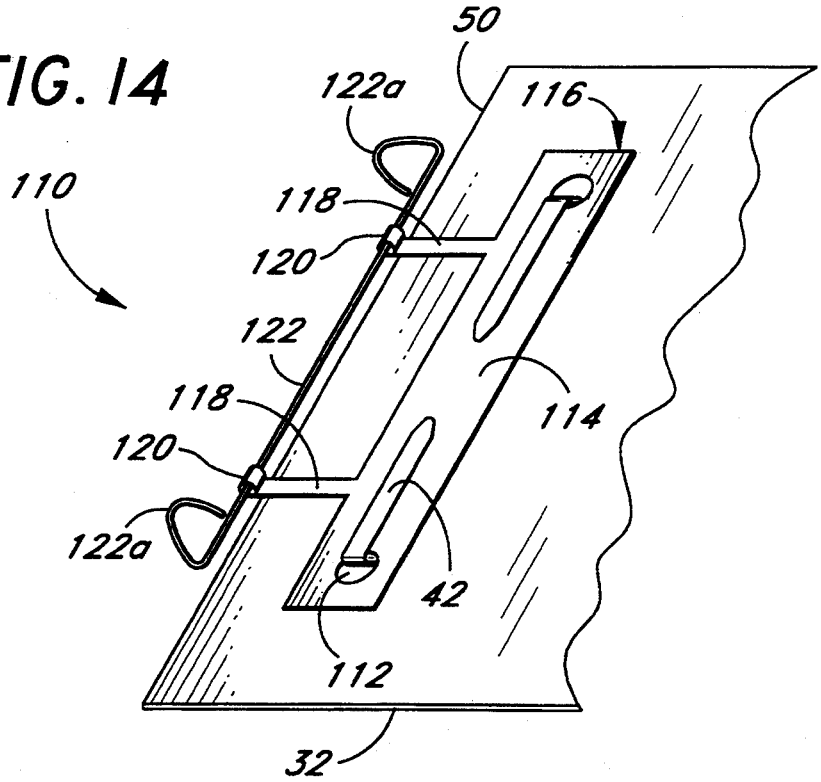
FIG. 14 is a perspective view of an alternative embodiment of a hinge and support for the retainers of the present invention arranged to be secured to a file folder with bendable tabs.

Several alternative embodiments of the hinged retainer system of FIG. 11 are shown in FIGS. 12–14. These alternative embodiments are designed to convert an existing conventional file folder into the hinged retainer system of the present invention by way of attachment to the file folder using the bendable metal tabs 42. The materials described for the various embodiments are used for example only, and other materials sharing similar qualities as the materials described may be utilized.

Referring to FIG. 12, an alternative hinge support 97 comprises a thin stiff paper or cardboard preferably reinforced with a foam backing (not shown). The hinge support 97 forms a widened T-shape with the middle portion 98 extending out in the lateral wing flaps 99. The lower edge 100 of the T is folded underneath the middle portion 98 and secured thereto with suitable adhesive to form an elongated looped section 101. Apertures 102 are formed in the wing flaps 99 a distance of approximately 2.75 inches apart, that being the typical distance between conventional perforations 64 in paper. The hinge rod is as described previously with the center straightened portion 56 and the two end hoops 58. The looped section 101 nearly spans the distance between the hoops 58 to allow the center rod 56 to rotate nearly 360°, yet constrain the end hoops from moving laterally more than approximately 2 mm. The folded edge 100 is epoxied or otherwise fastened to the lower face of the middle portion 98 in order to form a channel within the loop section 101 slightly larger than the center portion 56 of the hinge rod.

As was described in conjunction with the hinge support 38 of FIGS. 1–4, the hinge support 97 is detachably held to the file folder with the bendable tabs 42 such that the looped section 101 and hinge rod 55 extend slightly past the upper edge of the cover. In this manner, the hinge rod may rotate substantially all the way around to the back side 41 of the cover so that the retainers 60 and the whole stack 36 of loose-leaf sheets may also be pivoted about the looped section 101 and rotated to the underside of the cover. In addition, the close fit of the looped section 101 around the hinge rod reduces wear associated with any relative movement other than relative rotational movement.

In FIG. 13, a hinged retainer system 103 without the retainers 60 is shown installed on a file cover 32. A hinge support 104 comprised of a generally flat T-shaped sheet of stiff material includes perforations 105 in a pair of lateral side wings 106 through which the bendable tabs 42 extend to retain the hinge support to the cover 32. A middle portion 107, narrower than the wings 106, extends upward on the cover 32 and is bent upward and back to form an elongated hinge loop 108 centered slightly beyond the top edge 50 of the cover. A hinge rod 109, including side loops 109*a*, is pivotally retained within the hinge loop 108 such that the loops may lie substantially flat against either side of the cover 32.

The perforations 105 and hinge loops 109*a* are centered approximately 2.75 inches apart, or the typical span between perforations in paper. The body of the hinge support 104 may be constructed of steel, copper or any other suitably stiff metal which may be easily formed or, alternatively, molded from plastic. The hinge loop 108 is bent back in a generally circular configuration and closely surrounds the hinge rod 109 to prevent looseness and associated wear. In addition, the lateral width of the middle portion 107 extends approximately the entire distance between the hinge loops 109*a* so that relatively little lateral movement of the hinge rod is permitted.

An alternative hinged retainer system 110 with the retainers 60 removed is shown in FIG. 14. Conventional bendable tabs 42 extend through perforations 112 in a main body portion 114 of a hinge support 116 and are folded laterally to releasably affix the hinge support to a file folder cover 32. The hinge support 116 comprises the rectangular main body portion 114 and two integral fingers 118 extending to the top edge 50 of the cover 32. The fingers 118 are bent upward and back to form hinge loops 120, centered slightly past the top edge 50.

A hinge rod 122 having end hoops 122*a* is captured within each hinge loop 120 and may pivot within the loops so that the end hoops lie substantially flat against either side of the cover 32. The end hoops 122*a* are sized to receive the preferred retainer 60 of the present invention.

In a preferred sequence of assembly, the rod 122 is placed over the pre-bent fingers 118, whereupon the fingers are bent around the rod forming the hinge loops 120. The hinge rod 122 may be made out of relatively stiff plastic, metal or other stiff material. The hinged retainer system 110 is completed by passing the retainers 60 through the end hoops 122*a* and thereafter adding a stack of loose-leaf sheets in a similar manner as shown in FIGS. 2–4 for the preferred embodiment.

PREFERRED HINGED RETAINER SYSTEM

Referring now to FIG. 15 and 16*a–c*, a preferred embodiment of a hinged retainer system 124 without the retainer 60 is shown. A hinged support 126, constructed of a resilient material such as nylon or plastic, is shown attached to the file folder 32 in the conventional manner, with the bendable tabs 42 extending through perforations 128 in a main body portion 130. The hinged support 126 generally comprises the main body portion 130, having a generally rectangular configuration and designed to be held flat against the cover 32, and two hinge tabs 131*a*, 131*b*, having throughholes 133, separated from the main body portion by living hinges 132*a*, 132*b*. The living hinges 132*a,b* are disposed parallel and slightly beyond the top edge 50 of the cover and constitute regions of reduced thickness in the unitary hinge support material.

The living hinge 132, shown in detail in FIG. 16*c*, generally comprises a deep angled groove 134 on the underside of the support 126 and a shallow channel 135 on the opposite side. The upper side of the hinge support 126 is the side facing up corresponding to the top side of the cover 32. The angle groove 134 has rounded corners and makes an angle $\theta$ with the tab 131 and body 130 aligned. The side walls of the groove 134 eventually meet when the tab 131 pivots the angle $\theta$ toward the underside of the cover 32 of the cover and thus the tab is restricted from further pivot. Preferably, the angle $\theta$ is greater than 90° and, more preferably, the angle $\theta$ is 100°. However, the hinge tab 131 may be bent to lie completely flat over the main body portion 130 due to the lack of structural impediment in the channel 135 as opposed to the groove 134.

The material of the hinge support 126 is chosen so that the living hinge 132 may withstand repeated reversed bending stresses without failure. Preferably, the hinge support 126 is constructed from polyurethane.

A pair of retainers 60 extends through the holes 133 completing the hinged retainer system 124. Once again, the perforations 128 and throughholes 126 are sized approximately 2.75 inches apart, and the retainer system 124 is used to convert a conventional file folder 30 from the metal tab retainers 42 to the hinged retainer configuration.

In a slight variation on the hinge support 126 as shown in FIG. 17, a hinge support 136 comprises a main body portion 137 and an elongated hinge flap 138 separated by an elongated living hinge 139. The hinge flap 138 includes the end tabs 131 joined by a connector bridge 140. The connector bridge 140 preferably extends to the midpoint of the throughholes 133, but may extend a shorter distance, or all the way to the top of the tabs 131. The bridge 140 couples the movement of the tabs 131 to prevent any potential skewing of a stack of paper with the top edge 50 of the cover. The elongated living hinge 139 has a similar cross section as the short living hinges 132, seen in FIG. 16*c*, so that the flap 138 may pivot a total of approximately 280° from a position flush with the main body 137.

BLENDED HINGED RETAINER SYSTEM

Figure 18:
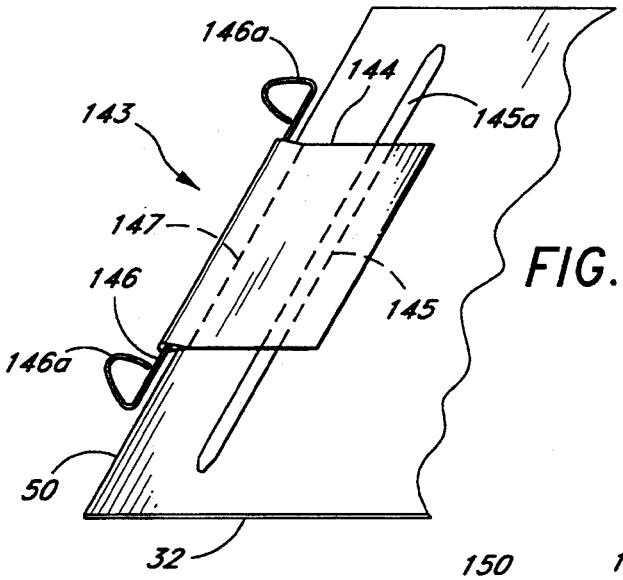
FIG. 18 is a perspective view of a file folder and a hinge and support incorporating bendable tabs.

Now referring to FIG. 18, a "blended" hinged retainer system 143 is shown without the retainers 60 and mounted to a file folder cover 32. The hinged retainer system 143 "blends" the advantages of the bendable tabs 42 for use with small stacks of paper with the hinged retainer system for larger stacks and generally comprises a hinge support 144, a strip of deformable metal 145 and a hinge rod 146 having end loops 146*a*. The hinge rod 146 may be identical to the hinge rod described for the embodiment of FIG. 11, or may be any other hinge rod configuration having a central straightened portion and two end loops. An end flap 147 of the hinge support 144 is folded under and adhered to the underside of the support to form an elongated hinge tube 148 centered slightly past the top edge 50 of the cover. As before, the hinge rod 146 is fit closely within the tube 148, is generally retained laterally therein and may rotate so that the hinge loops 146*a* may lie substantially flat against either side of the cover 32.

The deformable strip 145 adheres to the underside of the hinge support 144 and extends laterally therefrom in a pair of bendable tabs 145*a*, similar to those described previously. A stack of loose-leaf sheets may be retained on the file cover with the use of the deformable strip tabs 145*a* or, when the stack gets too large, with retainers 60 extending through the end loops 146*a* of the hinge rod 146. Alternatively, the deformable strip 145 may include one or more cutout notches or tabs (not shown) extending through apertures in the hinge support 144 enabling the strip to be "pinched" to the underside of the hinge support without being otherwise glued or fastened. This feature allows the strips 145 to be readily attached to a long row of connected hinge supports 144 facilitating an automated assembly procedure.

The entire assembly of the retainer system 143 is epoxied or otherwise adhered to the file cover 32. The assembly may be bonded by hot melting prior to sale or, alternatively, include a peel off label for attaching to folders already in the office supply. The assembled system 143, adhered to the file cover 32 or as a separate unit, is then sold as a "blended" package for the user to provide the advantageous flexibility of converting from a small stack retainer to a large stack retainer when desirable.

Figure 19:
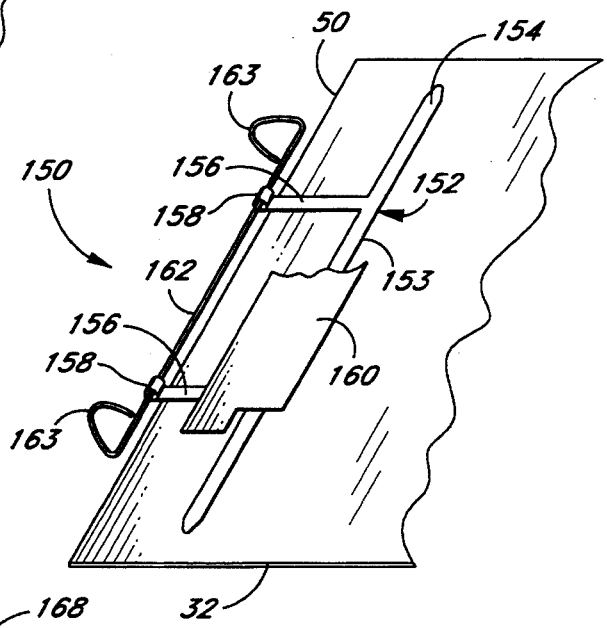
FIG. 19 is a perspective view of a file folder and an alternative embodiment of the hinge and support incorporating bendable tabs.

FIG. 19 illustrates another embodiment of the "blended" hinged retainer system 150 with the retainers 60 removed. The retainer system 150 generally comprises an inverted Pi-shaped hinge support 152 having a lateral cross bar 153 with extending tabs 154 and two fingers 156 extending perpendicular from the cross bar and terminating in hinge loops 158. The hinge support 152 is fixed to the file folder cover 32 with rivets (not shown) or with a covering strip 160, shown partially cutaway, adhered over the hinge support and to the file cover. The strip 160 may be paper, cellophane or other thin flexible material.

The hinge support 152 is held rigidly to the file cover 32 in a position where the tabs 154 may be utilized to retain a stack of paper through perforations or, alternatively, the hinged retainer system, as previously described, may be utilized. To form the hinged retainer system 150, a hinge rod 162 having end hoops 163 is held in the hinge loops 158, which extend slightly past the top edge 50 of the cover. The end hoops 163 receive the retainers 60 of the present invention in a similar manner as described for the convertible embodiment of FIG. 14. The "blended" hinged retainer system 150 is thus adapted to be installed on a file cover 32 and sold as a finished product, ready to accept either a thin stack of loose-leaf sheets in the metal tabs 154 or a thicker stack with the use of retainers 60.

Figure 20:
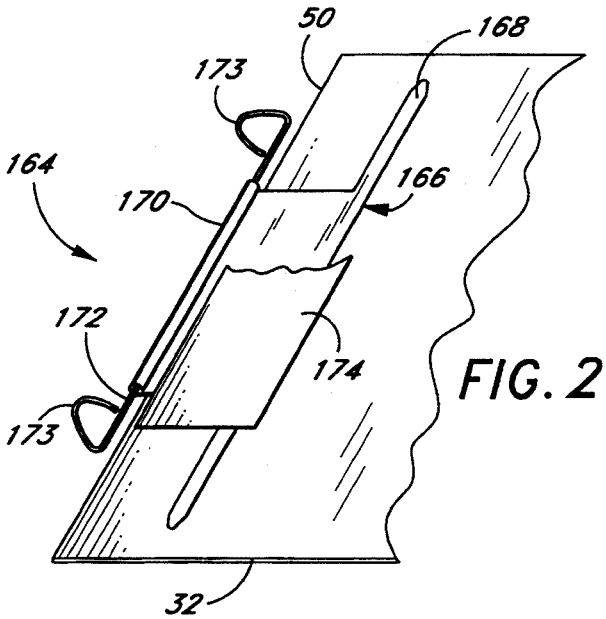
FIG. 20 is a perspective view of a file folder and a another alternative embodiment of the hinge and support incorporating bendable tabs.

In a variation from the embodiment shown in FIGS. 18 and 19, another alternative "blended" hinged retainer system 164 is shown in FIG. 20. The hinged retainer system 164 includes a hinge support 166 having laterally extending tabs 168 and an elongated hinged tube 170 disposed slightly past the top edge 50 of the file cover. The hinge support 166 may be constructed of steel, copper or any other suitably stiff metal which may be easily formed or, alternatively, molded from plastic. The hinge tube 170 closely encloses a hinge rod 172, similar to the embodiment of FIG. 18, whereby hinge rod loops 173 may pivot from positions flush with either side of the file cover. The hinge support 166 is rigidly secured to the cover with rivets (not shown) or, alternatively, has an overlying strip of paper 174 or other material adhered to the hinge support and to the cover. As with the "blended" embodiment described above, the hinged retainer system 164 is sold as installed on a cover and is capable of retaining small stacks of loose-leaf sheets with the use of the bendable tabs 168 or may include retainers 60 of the present invention to hold a larger stack of loose-leaf sheets.

ADD-ON RETAINER SYSTEMS

Figure 21:
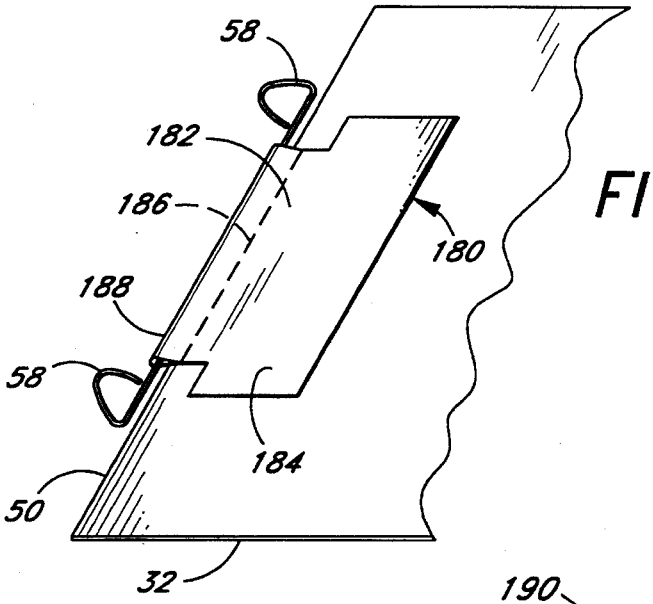
FIG. 21 is a perspective view of a file folder and a hinge and support configured to adhere to a file folder.

Referring to FIG. 21, a hinge support 180 comprises a thin stiff paper or cardboard and defines a widened T-shape with a middle portion 182 extending out in the lateral wing flaps 184. The lower edge 186 of the T is folded down underneath the middle portion 182 and secured thereto with suitable adhesive to form an elongated hinge tube 188. A hinge rod as described previously with end hoops 58 is held within the tube 188. The tube 188 nearly spans the distance between the hoops 58 to allow the center rod 56 to rotate nearly 360°, yet constrain the end hoops from moving laterally more than approximately 2 mm. The folded edge 186 is epoxied or otherwise fastened to the lower face of the middle portion 182 in order to form a channel within the loop section 188 slightly larger than the center portion 56 of the hinge rod.

The hinge support 180 is adhered to the file folder such that the hinge tube 188 and hinge rod 55 extend slightly past the upper edge of the cover. In this manner, the hinge rod may rotate substantially all the way around to the back side 41 of the cover so that the retainers 60 and the whole stack 36 of loose-leaf sheets may also be pivoted about the looped section 188 and rotated to the underside of the cover. In addition, the close fit of the looped section 188 around the hinge rod reduces wear associated with any relative movement other than relative rotational movement. The hinge support 180 is epoxied or otherwise adhered to the file cover 32 by hot melting to the cover and sold as an assembled unit. Alternatively, the underside of the support 180 may include a peel off label for attachment to folders already in the office supply and thus the support is sold independently from the file folder.

Figure 22:
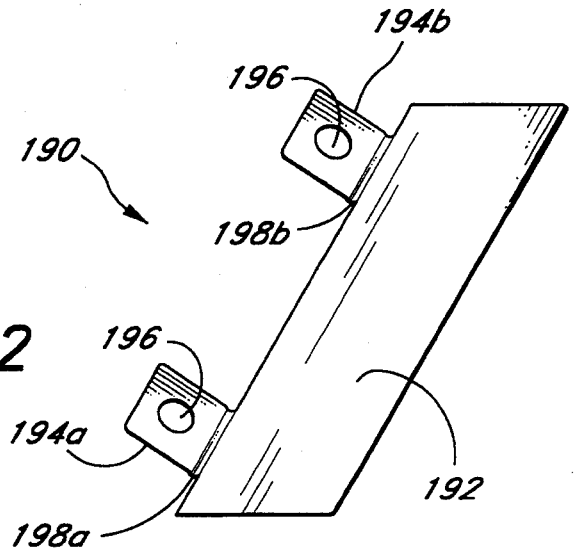
FIG. 22 is a perspective view of an alternative embodiment of the hinge and support configured to adhere to a file folder.

Referring to FIG. 22, an alternative embodiment of a hinged support 190 comprises a thin stiff paper or cardboard central body portion 192, having a generally rectangular configuration and adhered flush against a file cover, and two hinge tabs 194*a*, 194*b* having holes 196, separated from the main body portion by living hinges 198*a*, 198*b*. The living hinges 198*a,b* are disposed parallel and slightly beyond the top edge of the cover. In this manner, the tabs 194*a,b* may pivot substantially all the way around to the underside of the cover so that the retainers 60 and the whole stack 36 of loose-leaf sheets may also be pivoted about the tabs and rotated to the underside of the cover. Preferably, the paper is a tough cross-fiber blend to extend the useful life of the hinges 198. As was described above for the hinge support of FIG. 21, the hinge support 190 may be sold as an add-on item or assembled to a file cover and sold as a ready-to-use product.

Figure 23:
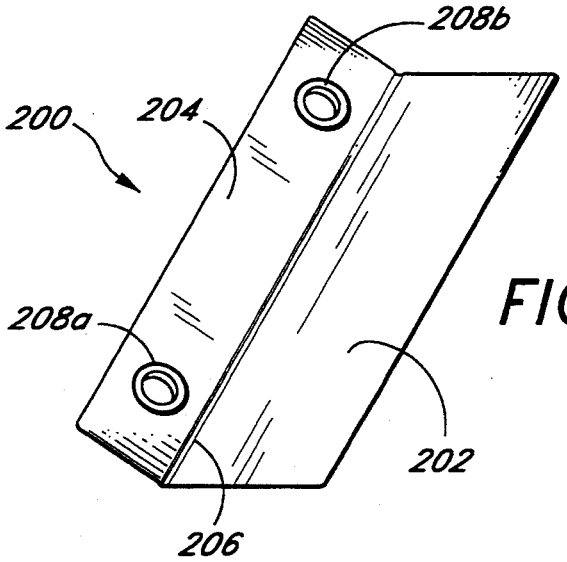
FIG. 23 is a perspective view of an alternative embodiment of the hinge and support configured to adhere to a file folder.

In another configuration, shown in FIG. 23, a hinge support 200 includes a main body portion 202 adhered flush with a file cover and a hinge flap 204 separated by an elongated living hinge 206. The hinge 206 is positioned slightly past the top edge of the cover to enable the flap 204 to be pivoted substantially flush with the top or bottom sides of the cover. Two eyelets 208*a*, 208*b* form holes for receiving the retainers 60 of the present invention and thus are disposed approximately 2.75 inches apart. As described above for the hinge support of FIG. 21, the hinge support 190 may be sold as an add-on item or assembled to a file cover and sold as a ready-to-use product.

Although this invention has been described in terms of certain preferred embodiments, other embodiments that are apparent to those of ordinary skill in the art are also within the scope of this invention.

Figure 24:
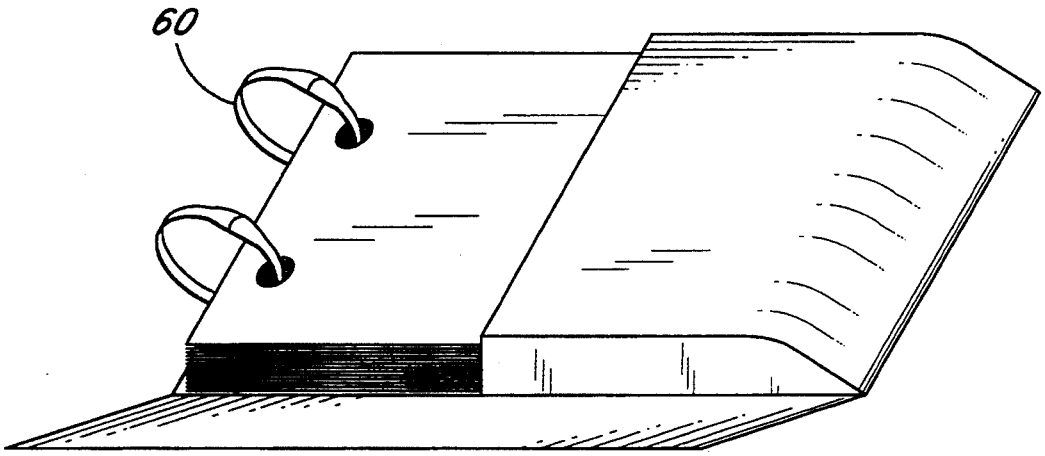
FIG. 24 is a perspective schematic view of a stack of sheets joined with flexible retainer loops, and positioned in a pocket of a file folder.
Figure 25:
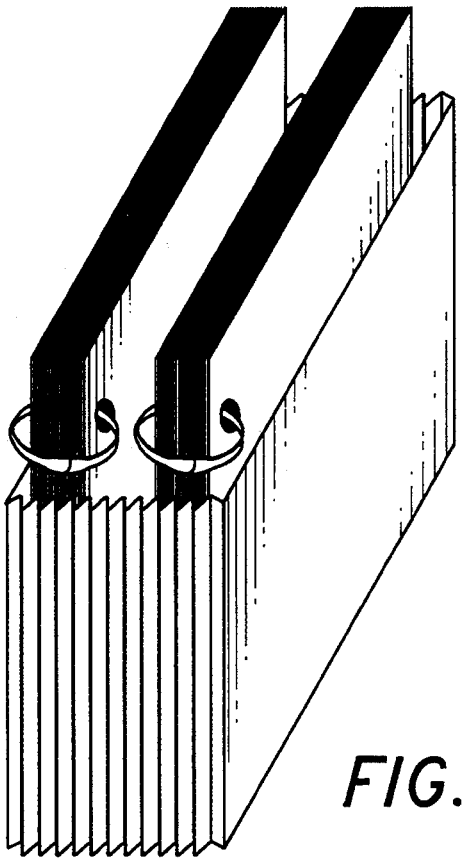
FIG. 25 is a perspective schematic view of stacks of sheets positioned in another type of pocket folder.

While the filing systems described above involve attaching a stack of sheets to a file folder in a secure manner, the benefits of random access for adding or removing sheets and for flat sheet copying can be obtained in another manner as well. Flexible retainers of the type shown in FIGS. 5–10 can be inserted through aligned holes in a stack of paper without attaching the stack to a file folder. Random access is then available. If the protection of a file folder is desired, the assembled stack can be placed in a pocket file, preferably an expandable pocket approach is particularly practical in situations in which the pockets are fairly permanent fixtures and the contents change frequently. Examples of these are shown in FIGS. 24 and 25.

What is claimed is:

1. A loose-leaf filing system, comprising:

a file folder panel;

a hinge loop pivotably mounted on said panel, the loop having a hinge axis positioned substantially on an edge of said panel to enable the loop to pivot at least 180° away from a position adjacent one side of said panel; and a thin flexible retainer sized to fit through said loop and through aligned mounting holes in a stack of sheets, said retainer having engaging portions that allow the retainer to be formed into a closed loop for retaining the sheets in the stack, said retainer further being constructed to enable the retainer to be rotated end-wise within said hinge loop, and opened and closed by way of said engaging portions to enable a particular sheet to be removed from the stack without removing any other sheets in the stack and to enable a sheet to be added to the stack at any desired location in the stack without removing any of the other sheets, said hinge loop and said retainer loop enabling any portion of said stack to be rotated to the back side of said panel and to lie flat on either the front or back of the stack, thereby enabling the stack to be placed on a copying machine and either side of any particular sheet in the stack to be copied without having to remove any of the sheets from the stack.

2. The system of claim 1, wherein said retainer includes an adjustment portion spaced along the length of said retainer and adapted to cooperate with one of said engaging portions to change the size of a closed loop that may be formed by the retainer so as to enable the retainer to snugly secure the stack of sheets.

3. The system of claim 2, wherein said retainer adjustment portion is formed to receive and firmly hold said one of said engaging portions by completely inserting said one of said engaging portions into said adjustment portion and applying a force to form said closed loop.

4. The system of claim 3, wherein said retainer adjustment portions comprise slots longitudinally arranged on said retainer, and a projection having a head and a neck, said slots having a head receiving portion sized to receive said head, a neck receiving portion sized to receive said neck and opposing lock nubs extending into the slot between said receiving portions and spaced a distance slightly smaller than the thickness of said neck, said projection thus being locked into said adjustment portions by inserting the projection completely through said head receiving portion and forcing said neck portion past said nubs into said neck receiving portion.

5. The system of claim 1, wherein said retainer engaging portions are formed on the ends of the retainer so that the retainer can be formed into a single loop without having excess retainer material extending beyond the portions which are engaging to form the retainer loop.

6. The system of claim 1, wherein said engaging portions include a socket on one end of the retainer and a projection on the other end of the retainer adapted to fit within said socket to form said retainer loop.

7. The system of claim 6, wherein said socket and said projection are formed in a manner such that the projection cannot be inserted into or removed from the socket without relative twisting of the socket and the projection.

8. The system of claim 7, wherein said projection has a head joined to the end of the retainer by a neck having a cross section smaller than that of the head, and said socket has an entry with a cross section similar to that of said head, and said socket has an enlarged rear portion within which said head can untwist to a locked position after having been twisted to be inserted in the socket.

9. The system of claim 1, including a second hinge loop and a hinge rod forming said axis and extending between and supporting said hinge loops; a hinge support attached to said panel for supporting said hinge rod substantially on said panel edge.

10. The system of claim 9, wherein said hinge rod support comprises an elongated tube having a generally C-shaped cross section or an elongated slit in a hinge rod support side wall, the slit being narrower than the diameter of the rod, but the portions of the tube forming the slit being sufficiently flexible to permit the rod to be snapped into the tube and to retain the rod in the tube for pivotal movement in the tube on said axis.

11. The system of claim 9, wherein said hinge rod support includes an elongated tube formed by folding a portion of said support upon itself and securing an edge of said support to the support at a location spaced from the support edge.

12. The system of claim 9, wherein said hinge rod support includes a pair of metal fingers extending outwardly from a main body portion of the support, said fingers having tips formed into a pair of spaced hinge rod support loops, said hinge rod support loops being spaced from each other a distance slightly less than the distance between said hinge loops.

13. The system of claim 9, wherein said hinge support comprises a flat element having a pair of spaced holes for receiving bendable metal prongs secured to said panel.

14. The system of claim 13, wherein said holes are spaced a distance approximately equal to the distance between said hinge loops so that said sheets may be secured in said stack by said metal prongs or by two of said retainers extending through said hinge loops.

15. The system of claim 13, wherein said hinge support is a flat element secured to said panel by a suitable adhesive.

16. The system of claim 9, including a flat strip of bendable metal secured to said panel by said hinge support, with end prongs of said strip extending beyond side edges of said support so that the prongs may be bent upwardly to extend through holes in said sheets, said hinge loops being spaced a distance approximately equal to the distance between said prongs so that said sheets may be secured in said stack by either said prongs or by two of said retainers extending through holes in said sheets and through said hinge loops.

17. The system of claim 1, including a second hinge loop and a flat hinge support element supporting said hinge loops and being secured to said panel by suitable adhesive or by bendable metal prongs attached to said panel and extending through spaced holes in said support.

18. The system of claim 1, including a second hinge loop and a hinge support secured to said panel and having hinge tabs with holes therein forming said hinge loops, said hinge tabs being joined to said support on a line forming said axis, said tabs being pivotable about said axis.

19. The system of claim 18, wherein said support, including said tabs, is formed of fairly stiff plastic, and the tabs are integrally joined to the remainder of said support by a living hinge.

20. The system of claim 19, wherein said tabs are joined by a connector bridge of support material to provide further stability to the hinge loops.

21. The system of claim 18, wherein said support is made of reinforced paper that extends to said panel edge.

22. The system of claim 21, wherein said hinge tabs form end portions of a hinge flap joining the hinge tabs.

23. The system of claim 22, including eyelets secured to said hinge tabs and forming said holes.

* * * * *